United States Patent [19]

Wooding et al.

[11] 4,115,654

[45] Sep. 19, 1978

[54] INTRODUCTION OF STARTING MOLTEN FLUX FROM THE TOP OF A CRUCIBLE

[75] Inventors: Patrick J. Wooding, Moorestown, N.J.; Clifton P. Anderson, Morrisville, Pa.

[73] Assignee: Wooding Corporation, Moorestown, N.J.

[21] Appl. No.: 773,330

[22] Filed: Mar. 1, 1977

[51] Int. Cl.[2] ..... F27D 3/14; H05B 3/60

[52] U.S. Cl. ..... 13/33; 13/9 ES

[58] Field of Search ..... 13/9 ES, 33; 214/35 R, 214/36, 18 SC

[56] References Cited

U.S. PATENT DOCUMENTS

| | | | |
|---|---|---|---|
| 2,191,475 | 2/1940 | Hopkins | 13/33 UX |
| 3,234,608 | 2/1966 | Peras | 13/9 ES UX |
| 3,876,417 | 4/1975 | Paton et al. | 13/9 |

*Primary Examiner*—R. N. Envall, Jr.

*Attorney, Agent, or Firm*—Duffield & Lehrer

[57] ABSTRACT

An elongated tubular member extends downwardly into the annular space between a consumable electrode and the crucible of an electroslag furnace. The tubular member guides pre-melted starting flux downwardly through the annular space to the bottom of the crucible while preventing the flux from contacting the inside walls of the crucible or the electrode.

14 Claims, 2 Drawing Figures

INTRODUCTION OF STARTING MOLTEN FLUX FROM THE TOP OF A CRUCIBLE

BACKGROUND OF THE INVENTION

The present invention is directed toward the introduction of starting molten flux to the bottom of a crucible in an electroslag melting furnace and more particularly to the introduction of starting molten flux from the top of the crucible.

The electroslag melting process was first invented, developed and put into full production by R. K. Hopkins in the United States during the period between 1930 and 1960. This process employs a consumable electrode which is immersed in a pool of molten slag supported at the top of the resultant solidifying ingot enclosed within a cold-walled mold or crucible.

Alternating (or sometimes direct) current flows down the consumable electrode through the slag, down the ingot and back to the power supply. Preferably, the current flows back to the power supply in a coaxial manner to the top of the crucible such as shown in co-pending application Ser. No. 616,365, filed Sept. 24, 1975 now U.S. Pat. No. 4,032,705. This current, normally in the range of 1,000 amps per inch of ingot diameter, drops from fifteen to forty volts across the slag (or flux) pool thereby producing hundreds of kilowatts of melting power which consumes the tip of the electrode.

As a result of the foregoing, molten metal droplets form on the immersed electrode tip, detach themselves and fall through the molten flux pool to the ingot which is forming there below. As the metal droplets pass through the flux pool, they undergo chemical refinement. Progressive solidification of the ingot formed by this method leads to the physical isotropy and high yield associated with all consumable electrode processes.

As is known in the art, most electroslag ingots of 24 inch diameter and larger are started by pre-melting a slag of suitable chemistry and pouring a six to eight inch deep pool of this molten slag into the bottom of the crucible. The electrode tip is then immersed to a depth of half an inch or so into this molten pool. The melting current flowing through the molten flux raises its temperature until the electrode begins to melt.

Molten flux (or slag) starting, as this technique is known, gives much higher utilization of the consumable (electroslag) furnace and better ingot yield than "dry" or cold starting because ingot bottom losses are minimized.

In the past, many methods have been attempted or proposed for the effective introduction of molten starting slag to the bottom of the crucible. One such system includes a means for introducing this molten flux through a conduit formed by the intersection of the crucible stool and the bottom flange of the crucible. Such a system is shown, for example, in U.S. Pat. Nos. 3,679,089 and 3,736,124.

As is demonstrated by these prior patents, it has heretofore been considered impractical to introduce molten slag through the very narrow annular space formed between the outside diameter of the electrode and the inside diameter of the crucible (a space generally restricted to lateral width of 1½ to 3 inches. This was true because the molten slag had a tendency to solidify on the outside surface of the electrode and the inside surface of the crucible thereby impairng melting, sharply affecting the accuracy of electrode weighing systems and tending to produce ingots of poor quality or abort the start.

SUMMARY OF THE INVENTION

The present invention overcomes these difficulties of delivering the entire pre-melted molten flux to the space between the bottom of the electrode and the top surface of the crucible stool by providing an elongated tubular member extending downwardly into the very narrow annular space between a consumable electrode and the crucible of an electroslag furnace. The tubular member guides pre-melted starting flux downwardly through the annular space to the bottom of the crucible while preventing the flux from contacting the inside walls of the crucible or the electrode.

BRIEF DESCRIPTION OF THE DRAWINGS

For the purpose of illustrating the present invention, there is shown in the accompanying drawings one form which is presently preferred; it being understood that the invention is not intended to be limited to the precise arrangements and instrumentalities shown.

DETAILED DESCRIPTION OF THE INVENTION

Figure 1:
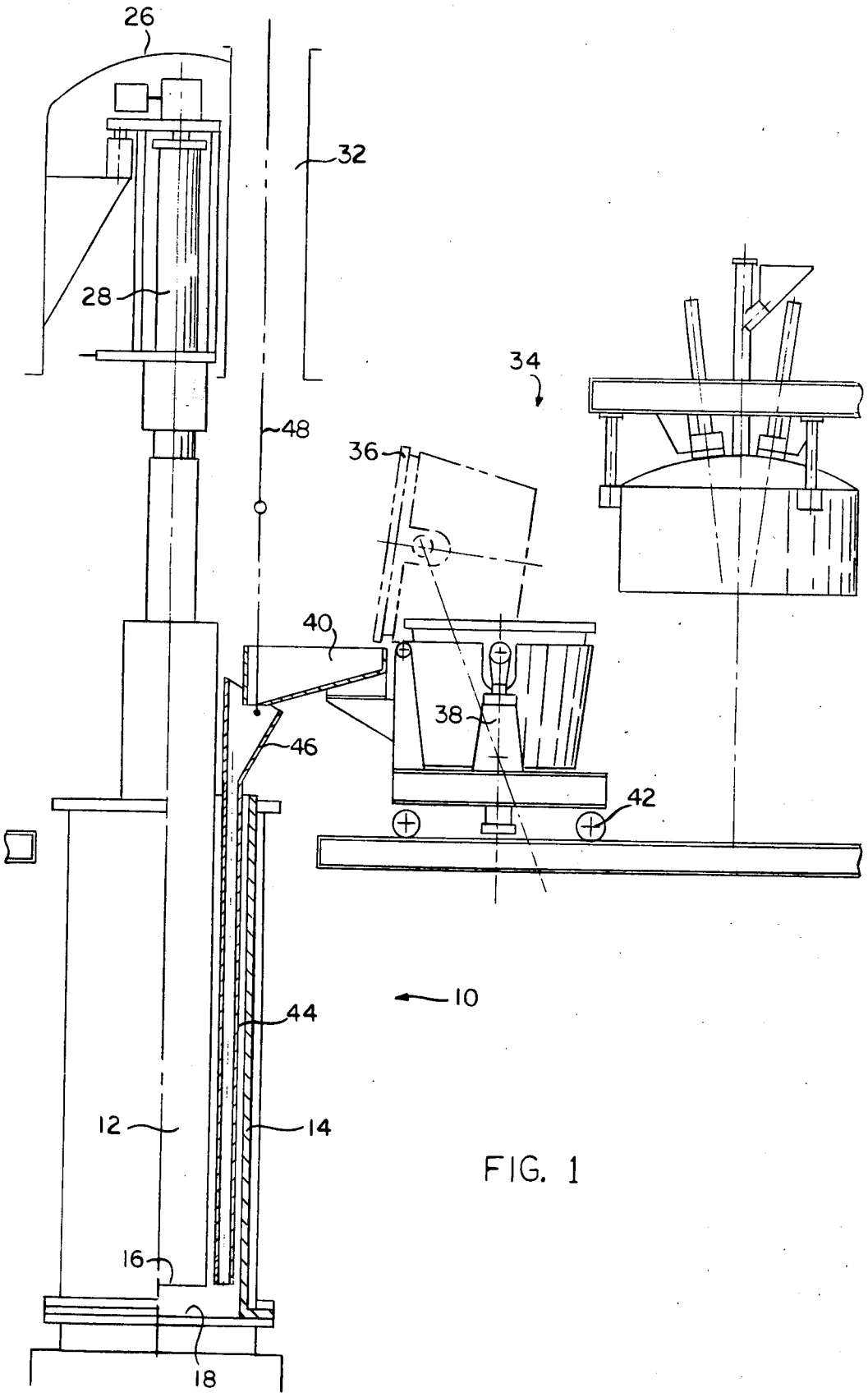
FIG. 1 is an elevational view partially in section of the present invention.
Figure 2:
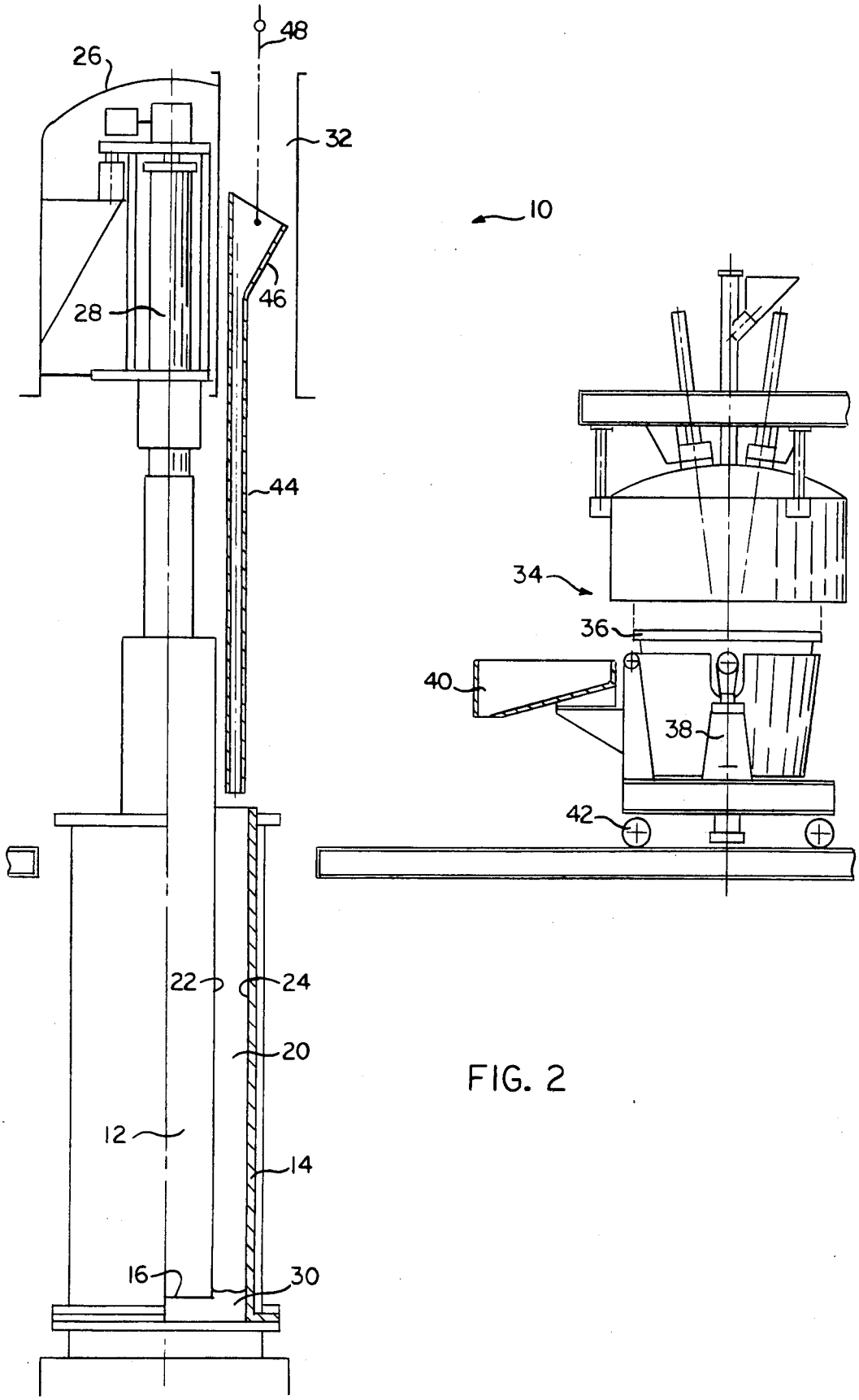
FIG. 2 is a view similar to FIG. 1 but showing the slag guide conduit removed from its operative position.

Referring now to the drawings in detail wherein similar reference numerals have been used in the two figures to identify similar components, there is shown in FIGS. 1 and 2 a general elevational view of an electroslag melting system and designated generally as 10.

The major components of the electroslag melting system 10 illustrated in the figures are generally known in the art. These include, for example, a consumable electrode 12 which is suspended within a crucible 14. Electrode 12 extends downwardly within the crucible 14 to a position wherein the tip 16 is spaced from the bottom wall 18 of the crucible. Electrode 12 is normally substantially cylindrically or rectangularly shaped and has an outside dimension which is normally only slightly less than the inside dimension of the crucible 14. Thus, a narrow annular space 20, which extends substantially the entire height of the crucible, remains between the outside surface 22 of the electrode 12 and the inside wall 24 of the crucible. It should be noted that the term annular is not intended to be limited to a circular shape but includes the space remaining between, for example, a rectangular electrode and a rectangular crucible.

Furnace head 26 located above the crucible 14 includes a ram 28 for moving the electrode 12 downwardly into the crucible 14 so as to maintain the tip 16 of the electrode immersed in the slag or flux pool 30. Furnace head 26 includes a vertically extending opening 32 passing there through; the function of which will become apparent hereinafter.

Shown to the right of the electroslag furnace in FIGS. 1 and 2 is a pre-melting furace, generally designated as 34, wherein the starting molten flux is prepared. The premelting furnace 34 includes a crucible 36 and cylinder means 38 for tilting the pre-melting crucible 36 so that the contents thereof can be poured into a launder 40 mounted at the forward end of the pre-melting furnace 34. The crucible 36 and related portions of the pre-melting furnace 34 are mounted on wheels 42 so that they can be moved toward and away from the electroslag melting furnace, when desired.

In accordance with the present invention, a conduit or tubular member 44 is inserted into the annular space 20 when it is desired to deliver pre-melted molten flux to the bottom of the crucible 14. The conduit 44 is comprised of a standard 1½ inch schedule 40 steel pipe which has been run through a pair of rollers to flatten it into roughly an elliptical cross section. The minor axis of the elliptical outside surface is approximately ¼ inch less in size than the annular space 20 between the outside surface 22 of the electrode 12 and the inside walls 24 of the crucible 14. That is, the tube 44 has one outside dimension which is only slightly less than the width of the space 20.

Welded to the top of the conduit 44 is a conically shaped tundish 46. The tundish 46 is preferably fabricated of sheet metal and has a suitable refractory lining capable of withstanding impingement of the molten flux to be poured therein. One or more steel cables 48 are connected to the tundish 46 so that the tundish 46 and conduit 44 can be moved between the operative position shown in FIG. 1 and the inoperative position shown in FIG. 2. An air or hydraulic cylinder (not shown) or similar means can be used to raise and lower the cable 48 and thus the conduit 44 and tundish 46.

The above described invention is used in the following manner. When it is desired to introduce starting molten flux into the bottom of the crucible 14, conduit 44 is lowered into the position shown in FIG. 1. The flux is melted in the pre-melting furnace 34 and the pre-melting crucible 36 is moved to the left and into the position shown in FIG. 1. Premelting crucible 36 is then tilted so that the flux is poured into the launder 40 and from there into the tundish 46 and down the conduit 44 to the bottom of the crucible 14.

After all of the pre-melting flux has been poured, the pre-melting furnace 34 and launder 40 move back to the position shown in FIG. 2. Simultaneously, the air or hydraulic cylinder supporting the conduit 44 through the steel cable 48 is actuated to withdraw the conduit 44 (and tundish 46) completely from the space 20. Withdrawal of the conduit 44 immediately after the pour prevents any possibility of a short circuit when power is applied to the electroslag melting furnace a few seconds after the completion of the pour. It should be readily apparent that electrical melting current had not been applied to the electrode until this time.

While the conduit 44 is shown to have a length which allows the bottom thereof to extend substantially to the same level as the bottom 16 of the electode 12, this is not entirely necessary. In addition to delivering the pre-melting flux to the bottom of the crucible 14, conduit 44 also functions to remove any horizontal vectors of the velocity of the falling pre-melted flux, In other words, the conduit 44 has the effect of forming the flux into a solid stream having only vertical components of velocity. Thus, the conduit 44 could stop, for example, approximately one third of the way down the crucible 14 and still accomplish its intended purpose. The conduit 44 need only be long enough to remove substantially all of the horizontal components of the velocity of the flux so as to form the flux into a relatively narrow stream. The stream of flux will continue to move downwardly and remain substantially in the narrow stream and thus will not contact the electrode 12 or the crucible 14.

Thus, it can be seen, that the conduit 44 functions to guide the flux to the bottom of the crucible even if the conduit 44 does not extend the entire length of the crucible. The length of the conduit needed to guide the flux properly depends on many variables including the size of the conduit and the size of the annular space. Accordingly, the length of the conduit 44 needed to properly guide the flux may differ from one application to the next.

It should be pointed out that as the flux passes through the conduit 44, it coats the inside thereof and solidifies. The solidified flux is a relatively good insulator and thus functions to protect the conduit 44. If, after several heats, too much flux solidifies within the conduit 44, it is only necessary to tap the conduit and the plug of solidified flux there within will shatter and drop out.

As shown in the drawings, one of the major advantages of the above-described invention is that the flux delivery system comprised of the conduit 44 and tundish 46 is relatively inexpensive and reusable. In addition, the pre-melting furnace may be placed at floor level which is more convenient and less expensive than placing it in a pit.

The present invention may be embodied in other specific forms without departing from the spirit or essential attributes thereof and, accordingly, reference should be made to the appended claims, rather than to the foregoing specification as indicating the scope of the invention.

We claim:

1. In an electroslag melting system including a crucible having interior side walls and an opening adjacent the top thereof, a consumable electrode extending downwardly through said opening into the interior of said crucible, the outer dimensions of said electrode being slightly less than the inside dimensions of said crucible whereby a narrow annular space remains between said electrode and the inside walls of said crucible and means for introducing pre-melted flux into the bottom of said crucible, the improvement comprising: means for guiding said pre-melted flux downwardly from said opening and through said narrow space while substantially preventing said flux from contacting said side walls of said crucible and said electrode.

2. The improvement as claimed in claim 1 wherein said means for guiding includes a substantially vertical tube extending downwardly within said space.

3. The improvement as claimed in claim 2 wherein said tube extends at least one third of the way down the length of said crucible.

4. The improvement as claimed in claim 2 wherein said tube extends substantially to the bottom of said electrode.

5. The improvement as claimed in claim 2 further including means for moving said tube between a first position where it extends within said space to a second position where it is substantially totally removed from within said space.

6. The improvement as claimed in claim 5 wherein said system includes a furnace head for supporting said electrode, said head including a vertically extending opening passing therethrough and wherein said means for moving said tube includes means for moving said tube into said opening.

7. The improvement as claimed in claim 2 wherein said tube is comprised of a tubular metal pipe.

8. The improvement as claimed in claim 2 wherein said tube has an outer dimension which is only slightly less than the width of said space.

9. In a process for operating an electroslag melting system including a crucible having interior side walls and an opening adjacent the top thereof, a consumable electrode extending downwardly through said opening into the interior of said crucible, the outer dimensions of said electrode being slightly less than the inside dimensions of said crucible whereby a narrow annular space remains between said electrode and the inside walls of said crucible, the improved process comprising introducing pre-melted starting flux into the bottom of said crucible by passing said pre-melted flux downwardly through a tube in said space thereby substantially preventing said flux from contacting said side walls of said crucible and said electode.

10. The improvement as claimed in claim 9 further including the step of removing said tube from said space after the level of said flux within said crucible reaches the bottom of said electrode.

11. The improvement as claimed in claim 10 further including the step of applying electrical melting current to said electrode after said tube is removed.

12. The improvement as claimed in claim 9 wherein said tube extends at least one third of the way down the length of said crucible.

13. The improvement as claimed in claim 12 wherein said tube extends substantially to the bottom of said electrode.

14. The improvement as claimed in claim 9 wherein said step of passing said flux is performed while withholding electrical melting current from said electrode.

* * * * *